US012473682B2

(12) United States Patent
Martinello et al.

(10) Patent No.: US 12,473,682 B2
(45) Date of Patent: Nov. 18, 2025

(54) OPTIMIZED DRYING CYCLE IN LAUNDRY APPLIANCES

(71) Applicant: Haier US Appliance Solutions, Inc., Wilmington, DE (US)

(72) Inventors: Daniele Martinello, Nuremberg (DE); Jivko Ognianov Djerekarov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 75 days.

(21) Appl. No.: 18/498,193

(22) Filed: Oct. 31, 2023

(65) Prior Publication Data

US 2025/0137187 A1 May 1, 2025

(51) Int. Cl.

| | |
|---|---|
| ***D06F 23/02*** | (2006.01) |
| ***D06F 25/00*** | (2006.01) |
| ***D06F 33/60*** | (2020.01) |
| ***D06F 33/68*** | (2020.01) |
| ***D06F 33/70*** | (2020.01) |
| ***D06F 34/18*** | (2020.01) |
| ***D06F 34/30*** | (2020.01) |
| ***D06F 35/00*** | (2006.01) |
| *D06F 103/06* | (2020.01) |
| *D06F 103/68* | (2020.01) |
| *D06F 105/20* | (2020.01) |

(52) U.S. Cl.

CPC ..... *D06F 34/18* (2020.02); *D06F 33/60* (2020.02); *D06F 33/70* (2020.02); *D06F 34/30* (2020.02); *D06F 23/02* (2013.01); *D06F 35/005* (2013.01); *D06F 2103/06* (2020.02); *D06F 2103/68* (2020.02); *D06F 2105/20* (2020.02)

(58) Field of Classification Search

None

See application file for complete search history.

(56) References Cited

U.S. PATENT DOCUMENTS

| | | | | |
|---|---|---|---|---|
| 2009/0071032 | A1 | 3/2009 | Kreutzfeldt et al. | |
| 2010/0154131 | A1* | 6/2010 | Paul | D06F 34/18 68/12.02 |

FOREIGN PATENT DOCUMENTS

| | | |
|---|---|---|
| CN | 111826912 A | 10/2020 |
| CN | 111676657 B | 3/2022 |
| KR | 101474432 B1 | 12/2014 |

* cited by examiner

*Primary Examiner* — Levon J Shahinian

(74) *Attorney, Agent, or Firm* — Dority & Manning, P.A.

(57) ABSTRACT

A method includes characterizing, by a laundry appliance, a first dry load size estimation of a load of articles in the laundry appliance, washing the load of articles in the laundry appliance, characterizing, by the laundry appliance, a wet load size estimation of the load of articles in the combination laundry appliance, determining a drying time for a drying operation of the laundry appliance for the load of articles based on the wet load size estimation and the first dry load size estimation of the load of articles, and drying the load of articles in the laundry appliance.

20 Claims, 8 Drawing Sheets

OPTIMIZED DRYING CYCLE IN LAUNDRY APPLIANCES

FIELD OF THE INVENTION

The present subject matter relates generally to laundry appliances, and more particularly to laundry appliances with optimized drying operations.

BACKGROUND OF THE INVENTION

Various laundry appliances include features for drying articles therein. For example, dryer appliances are typically paired with a separate washing machine appliance such that wet articles from the washing machine appliance may be loaded into the paired dryer appliance for drying.

Combination laundry appliances, sometimes also referred to as washer/dryer appliances, provide both washing and drying functions in a single unit. Combination laundry appliances may have one or more features or configurations for characterizing the load of articles, such as determining a size of the load of articles in the washing machine appliance. Such load information may also be useful in drying the load of articles. However, conventional approaches may lead to under-drying or over-drying of the load.

Accordingly, laundry appliances having features to optimize the drying operation in the laundry appliance, such as providing more accurate drying parameters based on a characterization of the load of articles by the laundry appliance would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure is a method of operating a combination laundry appliance, where the combination laundry appliance includes both a washing machine appliance and a dryer appliance. The method includes characterizing, by the combination laundry appliance, a first dry load size estimation of a load of articles in the combination laundry appliance, washing the load of articles in the combination laundry appliance, characterizing, by the combination laundry appliance, a wet load size estimation of the load of articles in the combination laundry appliance, determining a drying time for a drying operation of the combination laundry appliance for the load of articles based on the wet load size estimation and the first dry load size estimation of the load of articles, drying the load of articles in the combination laundry appliance, and characterizing, by the combination laundry appliance, a second dry load size estimation of the load of articles.

In another aspect of the present disclosure is a method of operating both of a washing machine appliance and a dryer appliance. The method includes characterizing, by the washing machine appliance, a first dry load size estimation of a load of articles in the washing machine appliance, washing the load of articles in the washing machine appliance, characterizing, by the washing machine appliance, a wet load size estimation of the load of articles in the washing machine appliance, determining a drying time for a drying operation of the dryer appliance for the load of articles based on the wet load size estimation and the first dry load size estimation of the load of articles, and drying the load of articles in the dryer appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
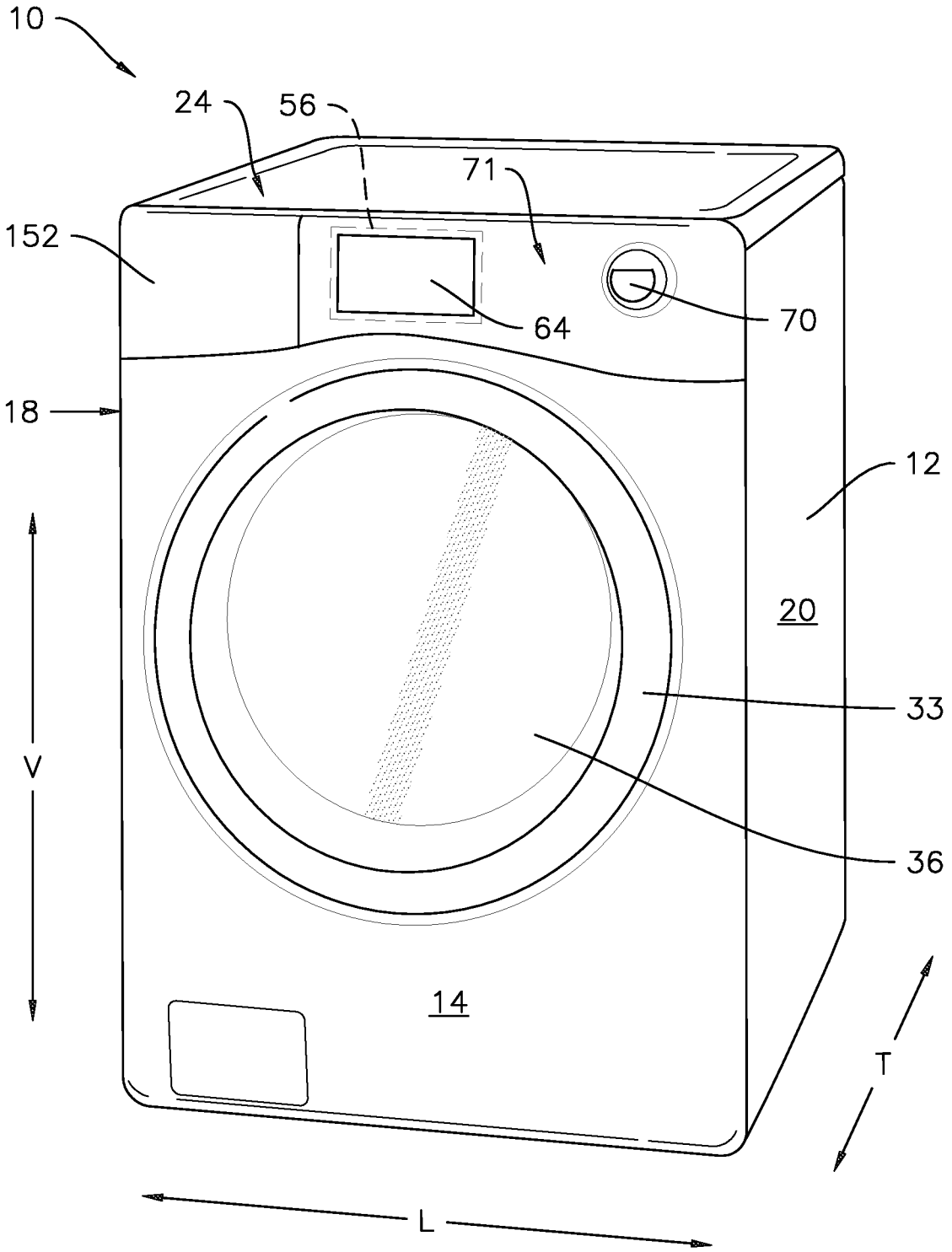
FIG. 1 provides a perspective view of a laundry appliance in accordance with one or more example embodiments of the present disclosure.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise, or counterclockwise.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

Figure 2:
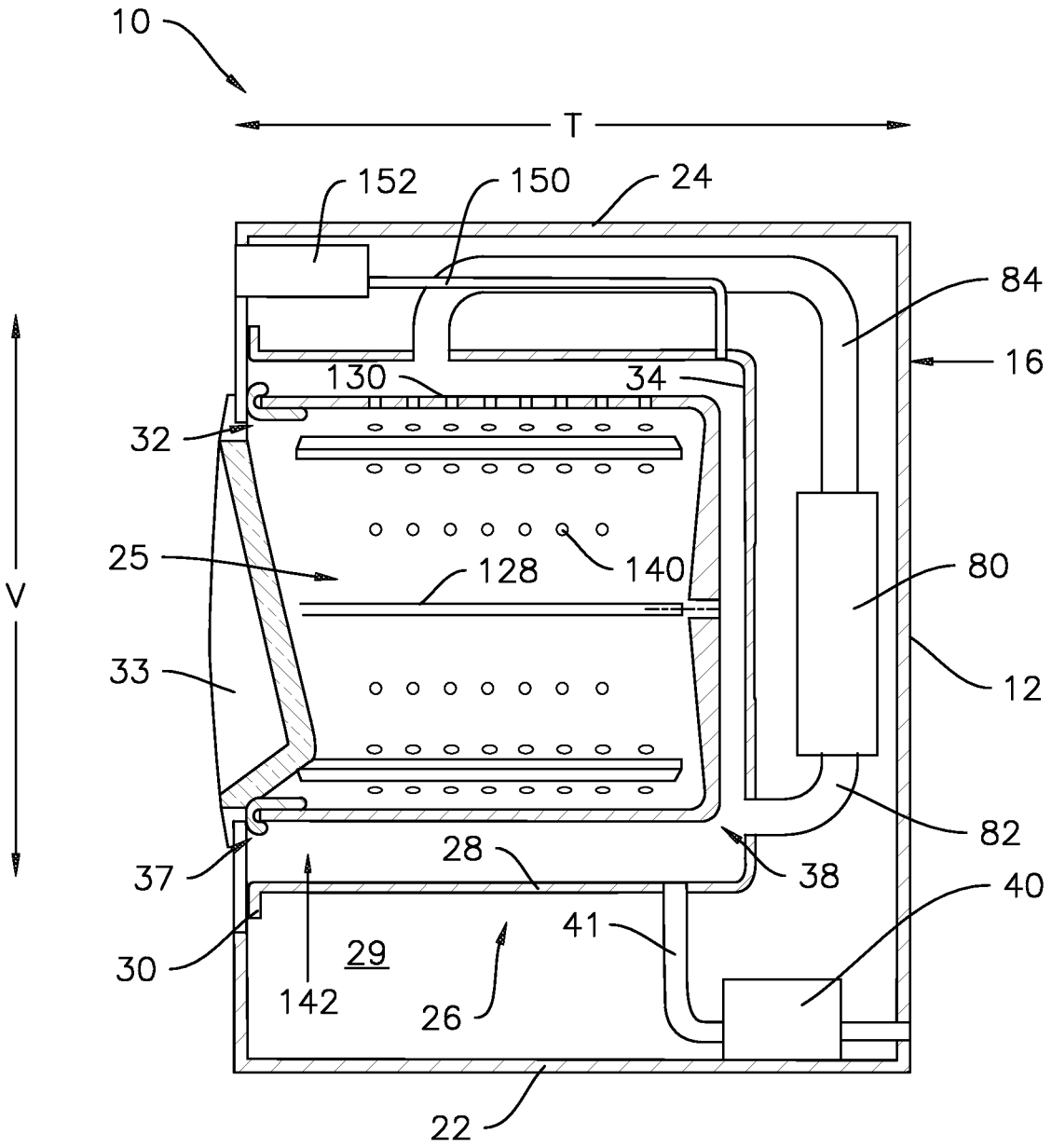
FIG. 2 provides a cross-section view of the example laundry appliance of FIG. 1.

Turning now to the figures, FIG. 1 provides a perspective view of a laundry appliance 10 according to example embodiments of the present disclosure. The laundry appliance 10 is a combination laundry appliance and may also be referred to as a multifunction laundry appliance or washer/dryer combination appliance. FIG. 2 provides a section view of laundry appliance 10. The laundry appliance 10 generally defines a vertical direction V, a lateral direction L, and a transverse direction T, each of which is mutually perpendicular, such that an orthogonal coordinate system is defined. While described in the context of a specific embodiment of laundry appliance 10, using the teachings disclosed herein, it will be understood that laundry appliance 10 is provided by way of example only. Other laundry appliances having different appearances and different features may also be utilized with the present subject matter as well.

Cabinet 12 includes a front panel 14, a rear panel 16, a left side panels 18 and a right side panel 20 spaced apart from each other by front and rear panels 14 and 16, a bottom panel 22, and a top cover 24. As used herein, terms such as "left" and "right" or "front" and "back" refer to directions from the perspective of a user facing the laundry appliance 10 for accessing and/or operating the laundry appliance 10. For example, a user stands in front of the laundry appliance 10, e.g., at or near the front panel 14, to access door 33 and/or inputs 70 (the door 33 and inputs 70 are described in more detail below). Within cabinet 12, an interior volume 29 is defined. A drum or tub 26 is mounted within the interior volume 29. A laundry basket 130 is mounted within the tub 26. The laundry basket 130 defines a chamber 25 for receipt of articles of clothing for treatment, e.g., washing, rinsing, spinning, tumbling, and/or drying.

In some embodiments, one or more selector inputs 70, such as knobs, buttons, touchscreen interfaces, etc., may be provided or mounted on the cabinet 12, e.g., on a control panel 71 thereof and are in operable communication (e.g., electrically coupled or coupled through a wireless network band) with a processing device or controller 56. The control panel 71 may also include a display 64. Controller 56 may also be provided in operable communication with various components of the dryer appliance, such as the motor, blower, and/or heating system 80. In turn, signals generated in controller 56 direct operation of such components in response to the position of inputs 70. As used herein, "processing device" or "controller" may refer to one or more microprocessors, microcontroller, ASICS, or semiconductor devices and is not restricted necessarily to a single element. Controller 56 may be programmed to operate laundry appliance 10 by executing instructions stored in memory (e.g., non-transitory media). Controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

Tub 26 extends between a front portion 37 and a back portion 38. Tub 26 is generally cylindrical in shape, having an outer cylindrical wall 28 and a front flange or wall 30 that defines an opening 32 of tub 26, e.g., at front portion 37 of tub 26, for loading and unloading of articles into and out of a chamber 25 defined by and within a laundry basket 130 inside of the tub 26. Tub 26 includes a rear wall 34 opposite the front flange 30. A door 33 provides for closing or accessing tub 26 through opening 32. A window 36 (FIG. 1) may be provided in door 33 for viewing of chamber 25 and/or laundry articles therein, e.g., during operation of the laundry appliance 10.

Laundry basket 130 is rotatably mounted within tub 26 such that the laundry basket 130 is rotatable about an axis of rotation. According to the illustrated embodiment, the axis of rotation is substantially parallel to the transverse direction T. In this regard, laundry appliance 10 is generally referred to as a "horizontal axis" or "front load" laundry appliance 10. However, it should be appreciated that aspects of the present subject matter may be used within the context of a vertical axis or top load laundry appliance as well.

Laundry appliance 10 includes a motor assembly (not shown) that is in mechanical communication with laundry basket 130 to selectively rotate laundry basket 130. The motor assembly may be a pancake motor or any other suitable type, size, or configuration of motor may be used to rotate laundry basket 130 according to various embodiments.

Laundry basket 130 may define one or more agitator features that extend into chamber 25 to assist in agitation and cleaning of articles disposed within laundry chamber 25 during operation of laundry appliance 10. For example, as illustrated in FIG. 2, a plurality of ribs 128 extends from laundry basket 130 into chamber 25. In this manner, for example, ribs 128 may lift articles disposed in laundry basket 130 during rotation of laundry basket 130, such as during an agitation or rinse portion of a wash operation of the laundry appliance 10. During a drying operation of the laundry appliance 10, the ribs 128 may also lift articles in the chamber 25 of the laundry basket 130 and then allow such articles to tumble back to a bottom of laundry basket 130 as laundry basket 130 rotates.

As illustrated for example in FIG. 2, laundry basket 130 may also include a plurality of perforations 140 extending therethrough in order to facilitate fluid communication between chamber 25 and tub 26, e.g., whereby wash liquid may flow between the tub 26 and the chamber 25 during a wash operation or cycle and/or heated air may flow into the chamber 25 and moisture-laden air may flow out of the chamber 25 during a drying operation or cycle. A sump 142 is defined by tub 26 outside of laundry basket 130 at a bottom of the tub 26 along the vertical direction V. Thus, sump 142 is configured for receipt of, and generally collects, wash liquid (the wash liquid may include, e.g., water, and may also include additives such as detergents, etc.) during wash operations of laundry appliance 10. For example, during a wash operation of laundry appliance 10, wash liquid may be urged (e.g., by gravity) from chamber 25 within the laundry basket 130 to sump 142 through the plurality of perforations 140. A pump assembly 40 is located beneath tub 26 for gravity assisted flow when draining tub 26 (e.g., via a drain 41). Pump assembly 40 is also configured for recirculating wash liquid within tub 26.

In some embodiments, laundry appliance 10 includes an additive dispenser or spout 150. For example, spout 150 may be in fluid communication with a water supply (not shown) in order to direct fluid (e.g., clean water) into tub 26. Spout 150 may also be in fluid communication with the sump 142. For example, pump assembly 40 may direct wash liquid disposed in sump 142 to spout 150 in order to circulate wash liquid in tub 26.

As illustrated, a detergent drawer 152 may be slidably mounted within front panel 14. Detergent drawer 152 receives an additive (e.g., detergent, fabric softener, bleach, or any other suitable liquid or powder) and directs the additive to chamber 25 during operation of laundry appliance 10. According to the illustrated embodiment, detergent drawer 152 may also be fluidly coupled to spout 150 to facilitate the complete and accurate dispensing of the additive.

In example embodiments, during operation of laundry appliance 10, laundry items are loaded into laundry basket 130 through opening 32, and an operation is initiated through operator manipulation of input selectors 70. For example, a wash cycle may be initiated such that tub 26 is filled with water, detergent, or other fluid additives (e.g., via spout 150). One or more valves (not shown) can be controlled by laundry appliance 10 to provide for filling laundry basket 130 to the appropriate level for the amount of articles being washed or rinsed. By way of example, once laundry basket 130 is properly filled with fluid, the contents of laundry basket 130 can be agitated (e.g., with ribs 128) for an agitation phase of laundry items in laundry basket 130. During the agitation phase, the basket 130 may be motivated about the axis of rotation at a set speed (e.g., a tumble speed). As the basket 130 is rotated, articles within the basket 130 may be lifted and permitted to drop therein.

After the agitation phase of the washing operation is completed, tub 26 can be drained. Laundry articles can then be rinsed (e.g., through a rinse cycle) by again adding fluid to tub 26, depending on the particulars of the cleaning cycle selected by a user. Ribs 128 may again provide agitation within laundry basket 130. One or more spin cycles may also be used. In particular, a spin cycle may be applied after the wash cycle or after the rinse cycle in order to wring wash liquid from the articles being washed. During a spin cycle, basket 130 is rotated at relatively high speeds. For instance, basket 130 may be rotated at one set speed before being rotated at another set speed. Moreover, agitation or tumbling of articles may be reduced as basket 130 increases its rotational velocity such that the plaster speed maintains the articles at a generally fixed position relative to basket 130.

After the spin cycle, a drying operation may begin. A supply duct 82 may be mounted to tub 26 and may extend between tub 26 and a heating assembly or system 80, whereby the tub 26 is downstream of the heating assembly 80 along the supply duct 82 such that the heating assembly 80 supplies heated air that has been heated by the heating assembly 80 to the tub 26 via the supply duct 82. A return duct 84 may also be mounted to the tub 26 and may extend between tub 26 and the heating assembly 80 whereby the tub 26 is upstream of the heating assembly 80 along the return duct 84 such that the heating assembly 80 receives relatively moist, humid, air from the tub 26 via the return duct 84, e.g., air returns to the heating system 80 from the tub 26, e.g., after flowing over and around articles within the chamber 25, through the return duct 84. The supply duct 82 may be mounted to the tub 26, e.g., at the rear wall 34 thereof as in the illustrated example, or the supply duct 82 may be mounted to the cylindrical wall 28 of the tub 26, such as above the basket 130, similar to the return duct 84 in the illustrated example embodiment.

The heating system 80 may include, e.g., a resistance heating element, a gas burner, and/or a heat pump, such as the example heat pump embodiment illustrated in FIG. 3 and described in more detail below. Moisture laden, heated air is drawn from tub 26 by an air handler, such as a blower fan, which generates a negative air pressure within chamber 25. As the air passes from the blower fan, it enters return duct 84 and then is passed into heating system 80. Heated air (with a lower moisture content than was received from tub 26), exits heating system 80 and is supplied to tub 26 by supply duct 82. After the clothing articles have been dried, they are removed from chamber 25 via opening 32.

Figure 3:
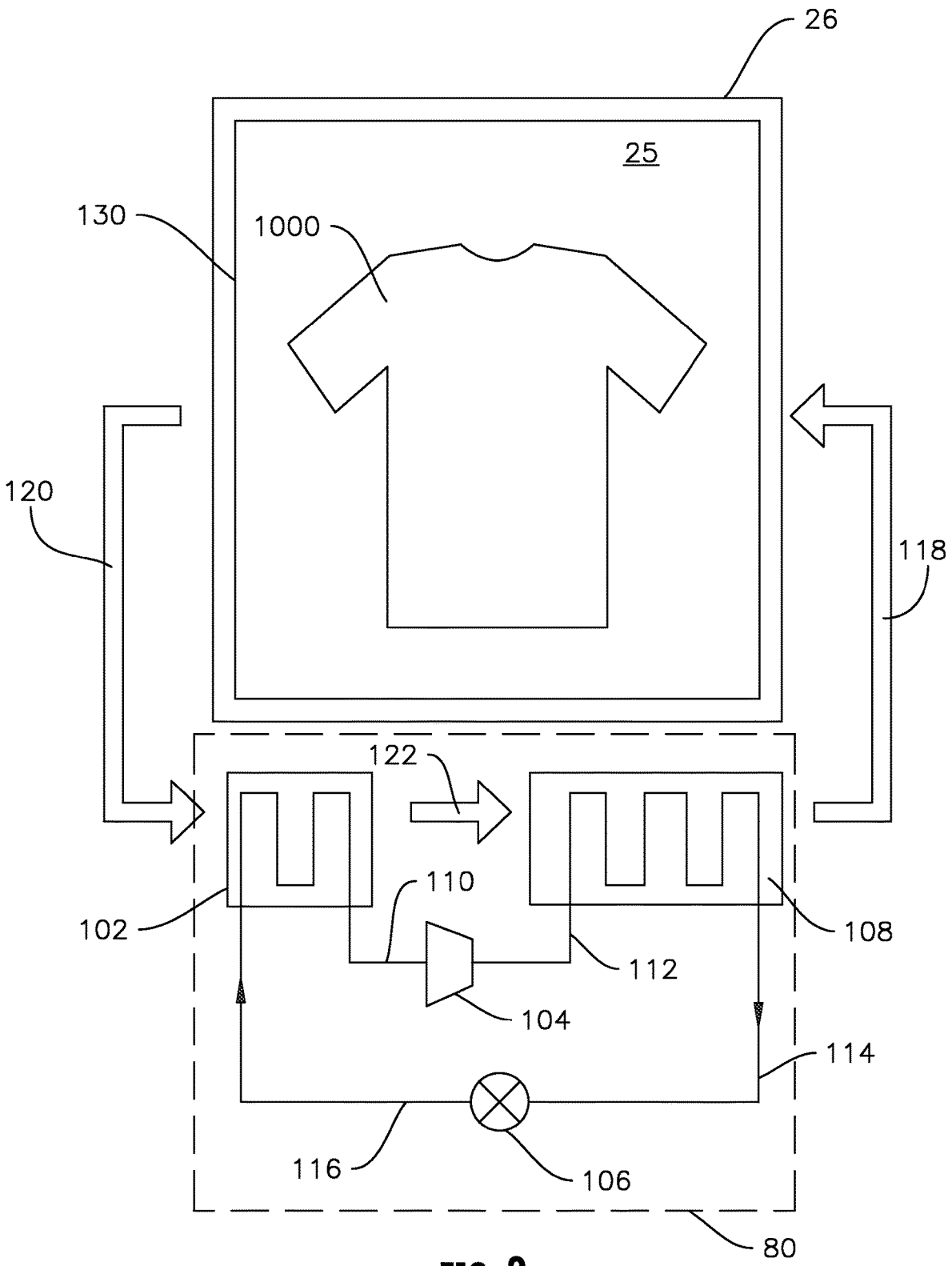
FIG. 3 provides a schematic diagram of an example laundry appliance according to one or more embodiments of the present disclosure.

Turning now to FIG. 3, a schematic view of selected components of one or more example embodiments of laundry appliance 10 is provided. In particular, FIG. 3 illustrates components used during drying operations of the laundry appliance 10. It is understood that, except as otherwise indicated, laundry appliance 10 in FIG. 3 may include some or all of the features described above with respect to FIGS. 1 and 2.

In operation, one or more laundry articles 1000 may be placed within chamber 25 of laundry basket 130. Hot dry air 118 may be supplied to chamber 25 whereby moisture within laundry articles 1000 may be drawn from the laundry articles 1000 by evaporation, such that warm saturated air 120 may flow from chamber 25 to an evaporator 102 of the heating system 80, e.g., via the return duct 84 illustrated in FIG. 2. As air passes across evaporator 102, the temperature of the air is reduced through heat exchange with refrigerant that is vaporized within, for example, coils or tubing of evaporator 102. This vaporization process absorbs both the sensible and the latent heat from the moisture laden air-thereby reducing its temperature. As a result, moisture in the air is condensed and such condensate may be drained from heating assembly 40, as will be understood by those of ordinary skill in the art.

Air passing over evaporator 102 becomes drier and cooler than when it was received from tub 26 of laundry appliance 10. As shown, cool dry air 122 from evaporator 102 is subsequently caused to flow across a condenser 108 (e.g., across coils or tubing of the condenser 108), which condenses refrigerant therein. The refrigerant enters condenser 108 in a gaseous state at a relatively high temperature compared to the air 122 from evaporator 102. As a result, heat energy is transferred to the air at the condenser section 108, thereby elevating the temperature of the air and providing warm dry air 118 for supply to the tub 26 of dryer appliance 10, e.g., via the supply duct 82 illustrated in FIG. 2. The warm dry air 118 passes over and around laundry articles 1000 within the chamber 25 of the tub 26, such that warm saturated air 120 is generated, as mentioned above. For example, the warm dry air may circulate around and through the articles 1000 while the articles 1000 are tumbled within the chamber 25 such as by rotating the basket 130, and the tumbling may be promoted by ribs 128 as well. Because the air is recycled through tub 26 and heating system 80, laundry appliance 10 can have a much greater efficiency than traditional clothes dryers where warm, moisture laden air is exhausted to the environment.

As shown, some embodiments of heating system 80 include a compressor 104 that pressurizes refrigerant (i.e., increases the pressure of the refrigerant) supplied by suction line 110 and generally motivates refrigerant through the sealed refrigerant circuit of heating system 80. Compressor 104 may be in operable communication with controller 56 and is generally designed to pressurize a gas phase refrigerant. Accordingly, in order to avoid damage, refrigerant in suction line 110 is supplied to the compressor 104 in a gas phase from the evaporator section 102. The pressurization of the refrigerant with compressor 104 increases the temperature of the refrigerant (e.g., as directed by controller 56). The compressed refrigerant is fed from compressor 104 to condenser 108 through line 112. As relatively cool air 122 from the evaporator 102 is passed over the condenser 108, the refrigerant is cooled and its temperature is lowered as heat is transferred to the air for supply to tub 26.

Upon exiting condenser 108, the refrigerant is fed through line 114 to an expansion device 106. Although only one expansion device 106 is shown, such is by way of example only. It is understood that multiple such devices may be used. In the illustrated example, expansion device 106 is a thermal expansion valve. In additional embodiments, any other suitable expansion device, such as a capillary tube, may be used as well as or instead of the thermal expansion valve 106. Expansion device 106 lowers the pressure of the refrigerant and controls the amount of refrigerant that is allowed to enter the evaporator 102 via line 116. Importantly, the flow of liquid refrigerant into evaporator 102 is limited by expansion device 106 in order to keep the pressure low and allow expansion of the refrigerant back into the gas phase in the evaporator 102. The evaporation of the refrigerant in the evaporator 102 converts the refrigerant from its liquid-dominated phase to a gas phase while cooling and drying the air 120 from tub 26. The process is repeated as air is circulated through tub 26 and between evaporator 102 and condenser 108 while the refrigerant is cycled through the sealed refrigerant circuit, as described above.

FIGS. 4 through 7 illustrate an example pair of laundry appliances, e.g., a washing machine appliance (FIGS. 4 and 5) and a dryer appliance (FIGS. 6 and 7), each of which may be one half of a pair of laundry appliances, such as together with the other illustrated example laundry appliance or with any other suitable washing machine appliance or dryer appliance. The laundry appliances may be paired in that they are mated together, e.g., connected, for communication between the appliances, such as wireless transmission and receipt of data and/or signals. Examples of data which may be communicated between the paired laundry appliances are discussed in more detail below. The washing machine appliance and the dryer appliance may also be paired in that they form a matched set which may be sold and/or used together. For example, the washing machine appliance and the dryer appliance may be located proximate to or next to each other, such as in the same room, e.g., laundry room or laundromat, for washing a load in the washing machine appliance that is then transferred to the dryer appliance for drying the load therein. In some embodiments, the pair of laundry appliances may be commercial laundry appliances, such as may be used in a laundromat, which are configured to be rented and may be usable on a per-cycle basis, e.g., wherein each laundry appliance is paid for by a user at each cycle and such payment unlocks a single usage of the laundry appliance.

Figure 4:
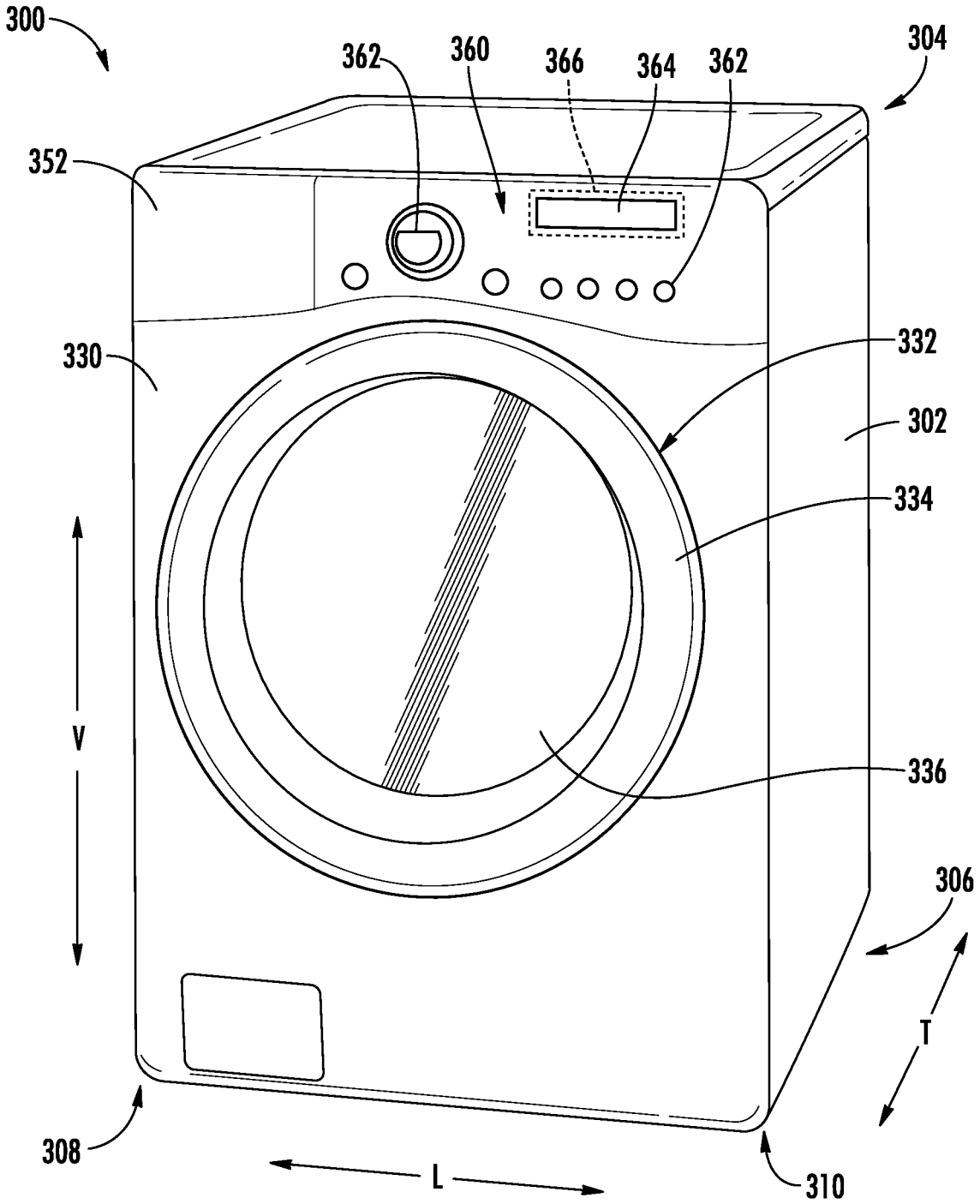
FIG. 4 provides a perspective view of a laundry appliance in accordance with one or more example embodiments of the present disclosure.
Figure 5:
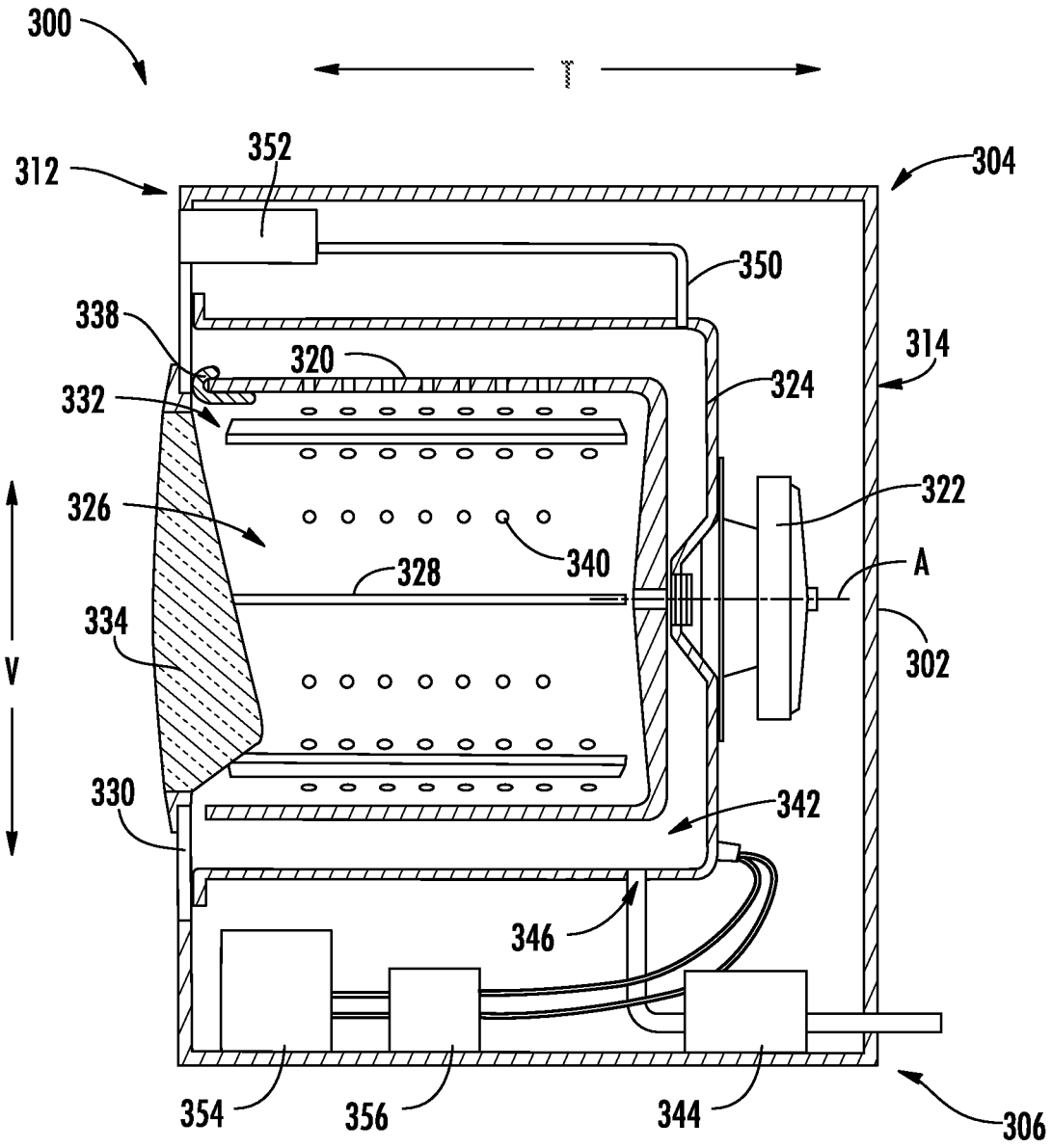
FIG. 5 provides a cross-section view of the example laundry appliance of FIG. 1.

FIG. 4 provides a perspective view of a washing machine appliance 300 according to example embodiments of the present disclosure. In particular, the example washing machine appliance illustrated in FIG. 4 is an example horizontal axis washing machine appliance 300. FIG. 5 is a side cross-sectional view of washing machine appliance 300 according to one example embodiment. As illustrated, washing machine appliance 300 generally defines a vertical direction V, a lateral direction L, and a transverse direction T, each of which is mutually perpendicular, such that an orthogonal coordinate system is generally defined. Washing machine appliance 300 includes a cabinet 302 that extends between a top 304 and a bottom 306 along the vertical direction V, between a left side 308 and a right side 310 along the lateral direction L, and between a front 312 and a rear 314 along the transverse direction T.

As may be seen in FIG. 5, a wash tub 324 is positioned within cabinet 302 and is generally configured for retaining wash fluids during an operating cycle. As used herein, "wash fluid" may refer to water, detergent, fabric softener, bleach, or any other suitable wash additive or combination thereof. Wash tub 324 is substantially fixed relative to cabinet 302 such that it does not rotate or translate relative to cabinet 302.

A wash basket 320 is received within wash tub 324 and defines a wash chamber 326 that is configured for receipt of articles for washing. More specifically, wash basket 320 is rotatably mounted within wash tub 324 such that it is rotatable about an axis of rotation A. According to the illustrated embodiment, the axis of rotation is substantially parallel to the transverse direction T. In this regard, washing machine appliance 300 is generally referred to as a "horizontal axis" or "front load" washing machine appliance 300. However, it should be appreciated that aspects of the present subject matter may be used within the context of a vertical axis or top load washing machine appliance as well.

Wash basket 320 may define one or more agitator features that extend into wash chamber 326 to assist in agitation and cleaning of articles disposed within wash chamber 326 during operation of washing machine appliance 300. For example, as illustrated in FIG. 5, a plurality of ribs 328 extends from basket 320 into wash chamber 326. In this manner, for example, ribs 328 may lift articles disposed in wash basket 320 during rotation of wash basket 320.

Washing machine appliance 300 includes a motor assembly 322 that is in mechanical communication with wash basket 320 to selectively rotate wash basket 320 (e.g., during an agitation or a rinse cycle of washing machine appliance 300). According to the illustrated embodiment, motor assembly 322 is a pancake motor. However, it should be appreciated that any suitable type, size, or configuration of motor may be used to rotate wash basket 320 according to alternative embodiments.

Referring generally to FIGS. 4 and 5, cabinet 302 also includes a front panel 330 that defines an opening 332 that permits user access to wash basket 320 of wash tub 324. More specifically, washing machine appliance 300 includes a door 334 that is positioned over opening 332 and is rotatably mounted to front panel 330 (e.g., about a door axis that is substantially parallel to the vertical direction V). In this manner, door 334 permits selective access to opening 332 by being movable between an open position (not shown) facilitating access to a wash tub 324 and a closed position (FIG. 4) prohibiting access to wash tub 324.

In some embodiments, a window 336 in door 334 permits viewing of wash basket 320 when door 334 is in the closed position (e.g., during operation of washing machine appliance 300). Door 334 also includes a handle (not shown) that, for example, a user may pull when opening and closing door 334. Further, although door 334 is illustrated as mounted to front panel 330, it should be appreciated that door 334 may be mounted to another side of cabinet 302 or any other suitable support according to alternative embodiments. Additionally or alternatively, a front gasket or baffle 338 may extend between tub 324 and the front panel 330 about the opening 332 covered by door 334, further sealing tub 324 from cabinet 302.

As illustrated for example in FIG. 5, wash basket 320 may also include a plurality of perforations 340 extending therethrough in order to facilitate fluid communication between an interior of basket 320 and wash tub 324. A sump 342 is defined by wash tub 324 at a bottom of wash tub 324 along the vertical direction V. Thus, sump 342 is configured for receipt of, and generally collects, wash fluid during operation of washing machine appliance 300. For example, during operation of washing machine appliance 300, wash fluid may be urged (e.g., by gravity) from basket 320 to sump 342 through the plurality of perforations 340. A pump assembly 344 is located beneath wash tub 324 for gravity assisted flow when draining wash tub 324 (e.g., via a drain 346). Pump assembly 344 is also configured for recirculating wash fluid within wash tub 324.

In some embodiments, washing machine appliance 300 includes an additive dispenser or spout 350. For example, spout 350 may be in fluid communication with a water supply (not shown) in order to direct fluid (e.g., clean water) into wash tub 324. Spout 350 may also be in fluid communication with the sump 342. For example, pump assembly 344 may direct wash fluid disposed in sump 342 to spout 350 in order to circulate wash fluid in wash tub 324.

As illustrated, a detergent drawer 352 may be slidably mounted within front panel 330. Detergent drawer 352 receives a wash additive (e.g., detergent, fabric softener, bleach, or any other suitable liquid or powder) and directs the fluid additive to wash chamber 326 during operation of washing machine appliance 300. According to the illustrated embodiment, detergent drawer 352 may also be fluidly coupled to spout 350 to facilitate the complete and accurate dispensing of wash additive.

In optional embodiments, a bulk reservoir 354 is disposed within cabinet 302. Bulk reservoir 354 may be configured for receipt of fluid additive for use during operation of washing machine appliance 300. Moreover, bulk reservoir 354 may be sized such that a volume of fluid additive sufficient for a plurality or multitude of wash cycles of washing machine appliance 300 (e.g., five, ten, twenty, fifty, or any other suitable number of wash cycles) may fill bulk reservoir 354. Thus, for example, a user can fill bulk reservoir 354 with fluid additive and operate washing machine appliance 300 for a plurality of wash cycles without refilling bulk reservoir 354 with fluid additive. A reservoir pump 356 is configured for selective delivery of the fluid additive from bulk reservoir 354 to wash tub 324.

A control panel 360 including a plurality of input selectors 362 is coupled to front panel 330. Control panel 360 and input selectors 362 collectively form a user interface input for operator selection of machine cycles and features. For example, in one embodiment, a display 364 indicates selected features, a countdown timer, or other items of interest to machine users.

Operation of washing machine appliance 300 is controlled by a controller or processing device 366 that is operatively coupled to control panel 360 for user manipulation to select washing machine cycles and features. In response to user manipulation of control panel 360, controller 366 operates the various components of washing machine appliance 300 to execute selected machine cycles and features.

Controller 366 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 366 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 360 and other components of washing machine appliance 300, such as motor assembly 322, may be in communication with controller 366 via one or more signal lines or shared communication busses. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In example embodiments, during operation of washing machine appliance 300, laundry items are loaded into wash basket 320 through opening 332, and a wash operation is initiated through operator manipulation of input selectors 362. For example, a wash cycle may be initiated such that wash tub 324 is filled with water, detergent, or other fluid additives (e.g., via spout 350). One or more valves (not shown) can be controlled by washing machine appliance 300 to provide for filling wash basket 320 to the appropriate level for the amount of articles being washed or rinsed. By way of example, once wash basket 320 is properly filled with fluid, the contents of wash basket 320 can be agitated (e.g., with ribs 328) for an agitation phase of laundry items in wash basket 320. During the agitation phase, the basket 320 may be motivated about the axis of rotation A at a set speed (e.g., a tumble speed). As the basket 320 is rotated, articles within the basket 320 may be lifted and permitted to drop therein.

After the agitation phase of the washing operation is completed, wash tub 324 can be drained. Laundry articles can then be rinsed (e.g., through a rinse cycle) by again adding fluid to wash tub 324, depending on the particulars of the cleaning cycle selected by a user. Ribs 328 may again provide agitation within wash basket 320. One or more spin cycles may also be used. In particular, a spin cycle may be applied after the wash cycle or after the rinse cycle in order to wring wash fluid from the articles being washed. During a spin cycle, basket 320 is rotated at relatively high speeds.

After articles disposed in wash basket 320 are cleaned (or the washing operation otherwise ends), a user can remove the articles from wash basket 320 (e.g., by opening door 334 and reaching into wash basket 320 through opening 332).

Figure 6:
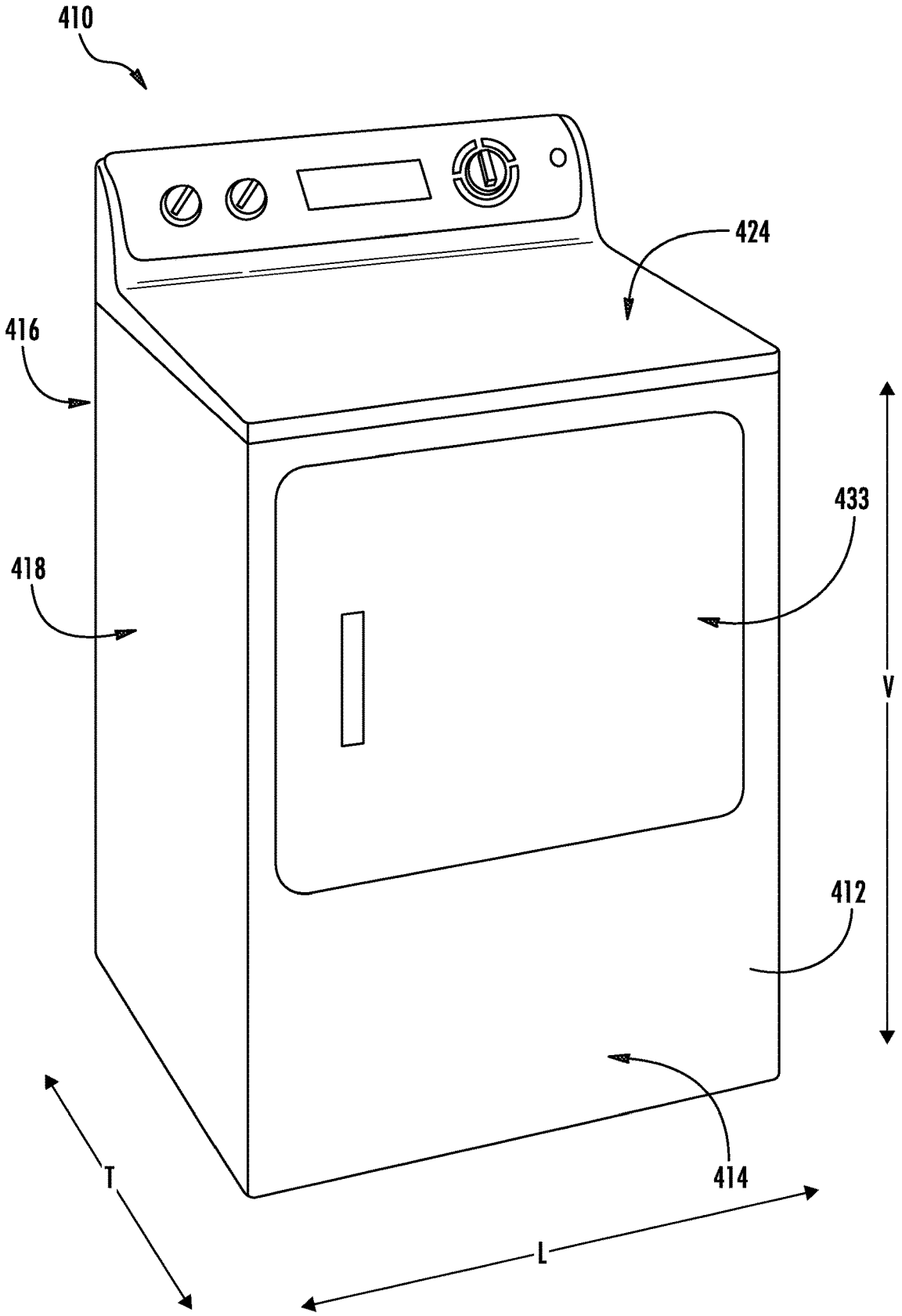
FIG. 6 provides a perspective view of another laundry appliance as may be used with one or more additional example embodiments of the present disclosure.
Figure 7:
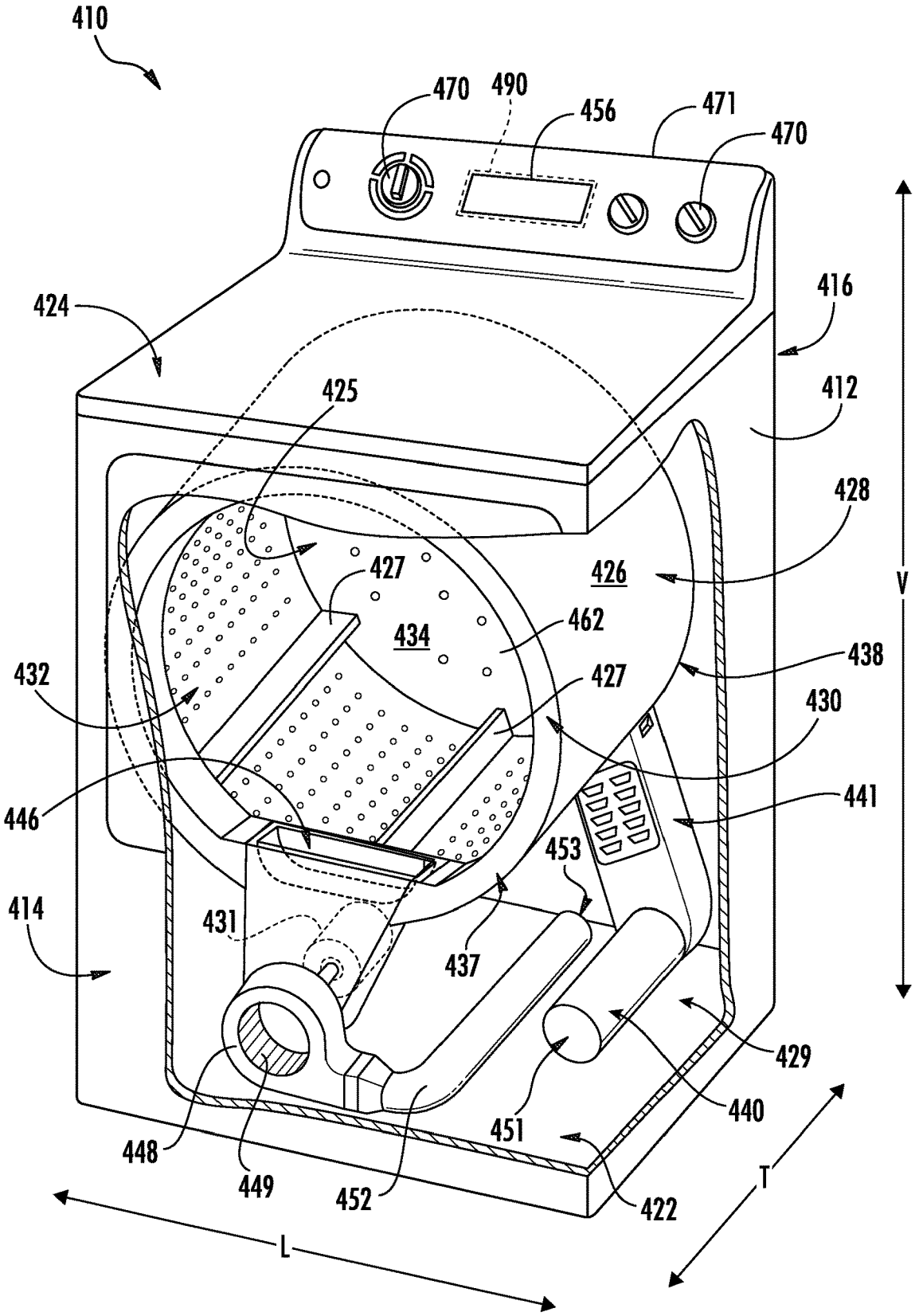
FIG. 7 provides a perspective view of the example laundry appliance of FIG. 3 with portions of a cabinet of the laundry appliance removed to reveal certain components of the laundry appliance.

FIG. 6 provides a perspective view of dryer appliance 410 according to one or more example embodiments of the present disclosure. FIG. 7 provides another perspective view of dryer appliance 410 with a portion of a cabinet or housing 412 of dryer appliance 410 removed in order to show certain components of dryer appliance 410. Dryer appliance 410 generally defines a vertical direction V, a lateral direction L, and a transverse direction T, each of which is mutually perpendicular, such that an orthogonal coordinate system is defined. While described in the context of a specific embodiment of dryer appliance 410, using the teachings disclosed herein, it will be understood that dryer appliance 410 is provided by way of example only. Other dryer appliances having different appearances and different features may also be utilized with embodiments of the present subject matter.

Cabinet 412 includes a front panel 414, a rear panel 416, a pair of side panels 418 and 420 spaced apart from each other by front and rear panels 414 and 416, a bottom panel 422, and a top cover 424. Within cabinet 412, an interior volume 429 is defined. A drum or container 426 is mounted for rotation about a substantially horizontal axis within the interior volume 429. Drum 426 defines a chamber 425 for receipt of articles of clothing for tumbling and/or drying. Drum 426 extends between a front portion 437 and a back portion 438. Drum 426 also includes a back or rear wall 434, e.g., at back portion 438 of drum 426. A supply duct 441 may be mounted to rear wall 434 and receives heated air that has been heated by a heating assembly or system 440.

A motor 431 is provided in some embodiments to rotate drum 426 about the horizontal axis, e.g., via a pulley and a belt (not pictured). Drum 426 is generally cylindrical in shape, having an outer cylindrical wall 428 and a front flange or wall 430 that defines an opening 432 of drum 426, e.g., at front portion 437 of drum 426, for loading and unloading of articles into and out of chamber 425 of drum 426. A plurality of lifters or baffles 427 are provided within chamber 425 of drum 426 to lift articles therein and then allow such articles to tumble back to a bottom of drum 426 as drum 426 rotates. Baffles 427 may be mounted to drum 426 such that baffles 427 rotate with drum 426 during operation of dryer appliance 410.

Drum 426 includes a rear wall 434 rotatably supported within main housing 412 by a suitable fixed bearing. Rear wall 434 can be fixed or can be rotatable. Rear wall 434 may include, for instance, a plurality of holes that receive hot air that has been heated by a heating assembly or system 440, as will be described further below. Motor 431 is also in mechanical communication with an air handler 448 such that motor 431 rotates a fan 449, e.g., a centrifugal fan, of air handler 448. Air handler 448 is configured for drawing air through chamber 425 of drum 426, e.g., in order to dry articles located therein. In alternative example embodiments, dryer appliance 410 may include an additional motor (not shown) for rotating fan 449 of air handler 448 independently of drum 426.

Drum 426 is configured to receive heated air that has been heated by a heating assembly 440, e.g., via holes in the rear wall 434 as mentioned above, in order to dry damp articles disposed within chamber 425 of drum 426. For example, heating assembly 440 may include any suitable heat source, such as a gas burner, an electrical resistance heating element, or heat pump, for heating air. As discussed above, during operation of dryer appliance 410, motor 431 rotates drum 426 and fan 449 of air handler 448 such that air handler 448 draws air through chamber 425 of drum 426 when motor 431 rotates fan 449. In particular, ambient air enters heating assembly 440 via an inlet 451 due to air handler 448 urging such ambient air into inlet 451. Such ambient air is heated within heating assembly 440 and exits heating assembly 440 as heated air. Air handler 448 draws such heated air through supply duct 441 to drum 426. The heated air enters drum 426 through a plurality of outlets of supply duct 441 positioned at rear wall 434 of drum 426.

Within chamber 425, the heated air may accumulate moisture, e.g., from damp clothing disposed within chamber 425. In turn, air handler 448 draws moisture-saturated air through a screen filter (not shown) which traps lint particles. Such moisture-statured air then enters an exit duct 446 and is passed through air handler 448 to an exhaust duct 452. From exhaust duct 452, such moisture-statured air passes out of dryer appliance 410 through a vent 453 defined by cabinet 412. After the clothing articles have been dried, they are removed from the drum 426 via opening 432. A door 433 (FIG. 6) provides for closing or accessing drum 426 through opening 432. The door 433 may be movable between an open position and a closed position, the open position for access to the chamber 425 defined in the drum 426, and the closed position for sealingly enclosing the chamber 425 defined in the drum 426.

In some embodiments, one or more selector inputs 470, such as knobs, buttons, touchscreen interfaces, etc., may be provided or mounted on a cabinet 412 (e.g., on a backsplash 471 of the cabinet 412) and are in operable communication (e.g., electrically coupled or coupled through a wireless network band) with a processing device or controller 490. A display 456 may also be provided on the backsplash 471 and may also be in operable communication with the controller 490. Controller 490 may also be provided in operable communication with motor 431, air handler 448, and/or heating assembly 440. In turn, signals generated in controller 490 direct operation of motor 431, air handler 448, and/or heating assembly 440 in response to the position of inputs 470. In the example illustrated in FIGS. 6 and 7, the inputs 470 are provided as knobs. In other embodiments, inputs 470 may also or instead include buttons, switches, touchpads and/or a touch screen type interface.

Controller 490 is a "processing device" or "controller" and may be embodied as described herein. As used herein, "processing device" or "controller" may refer to one or more microprocessors, microcontrollers, application-specific integrated circuits (ASICS), or semiconductor devices and is not restricted necessarily to a single element. The controller 490 may be programmed to operate dryer appliance 410 by executing instructions stored in memory (e.g., non-transitory media). The controller 490 may include, or be associated with, one or more memory elements such as RAM, ROM, or electrically erasable, programmable read only memory (EEPROM). For example, the instructions may be software or any set of instructions that when executed by the processing device, cause the processing device to perform operations. Controller 490 may include one or more processor(s) and associated memory device(s) configured to perform a variety of computer-implemented functions and/or instructions (e.g. performing the methods, steps, calculations and the like and storing relevant data as disclosed herein). It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In particular, dryer appliance 410 and/or the controller thereof, e.g., controller 490, may be operable to and configured to perform methods as described herein. In some embodiments, the dryer appliance and/or the controller thereof may be coupled to a washing machine appliance, e.g., washing machine appliance 300 described above, such as communicatively coupled for wired or wireless communication, e.g., of laundry information such as load mass and/or load type from the washing machine appliance to the dryer appliance.

For example, example methods, as will be described hereinbelow, may include determining the load type of articles in the wash chamber of the washing machine appliance 300, e.g., the controller 366, and/or appliance 10, e.g., controller 56, may be configured to determine a load type of articles within wash chamber 25, 326 of basket 130, 320. As used herein, the term "load type" corresponds to a composition or fabric type of articles, e.g., within wash chamber 25, 326 of basket 130, 320. As an example, the load type of such articles may be natural, synthetic, or blended. A natural load type may include entirely or predominantly articles composed of natural fiber fabrics, such as cotton. A synthetic load type may include synthetic articles, such as nylon or polyester articles. If a mixed or blended load of articles is disposed within wash chamber 25, 326 of basket 130, 320, the load type of such articles is a mixed or blended load type. Thus, the blended load type can correspond to a blend of cotton articles and synthetic articles within wash chamber 25, 326 of basket 130, 320.

The load type of articles within wash chamber 326 of basket 320 may be determined at least in part based on mass of the articles and the absorptivity of the articles. For example, natural articles such as cotton articles can have a relatively high absorptivity whereas synthetic articles, such as nylon or polyester articles, can have a relatively low absorptivity.

Figure 8:
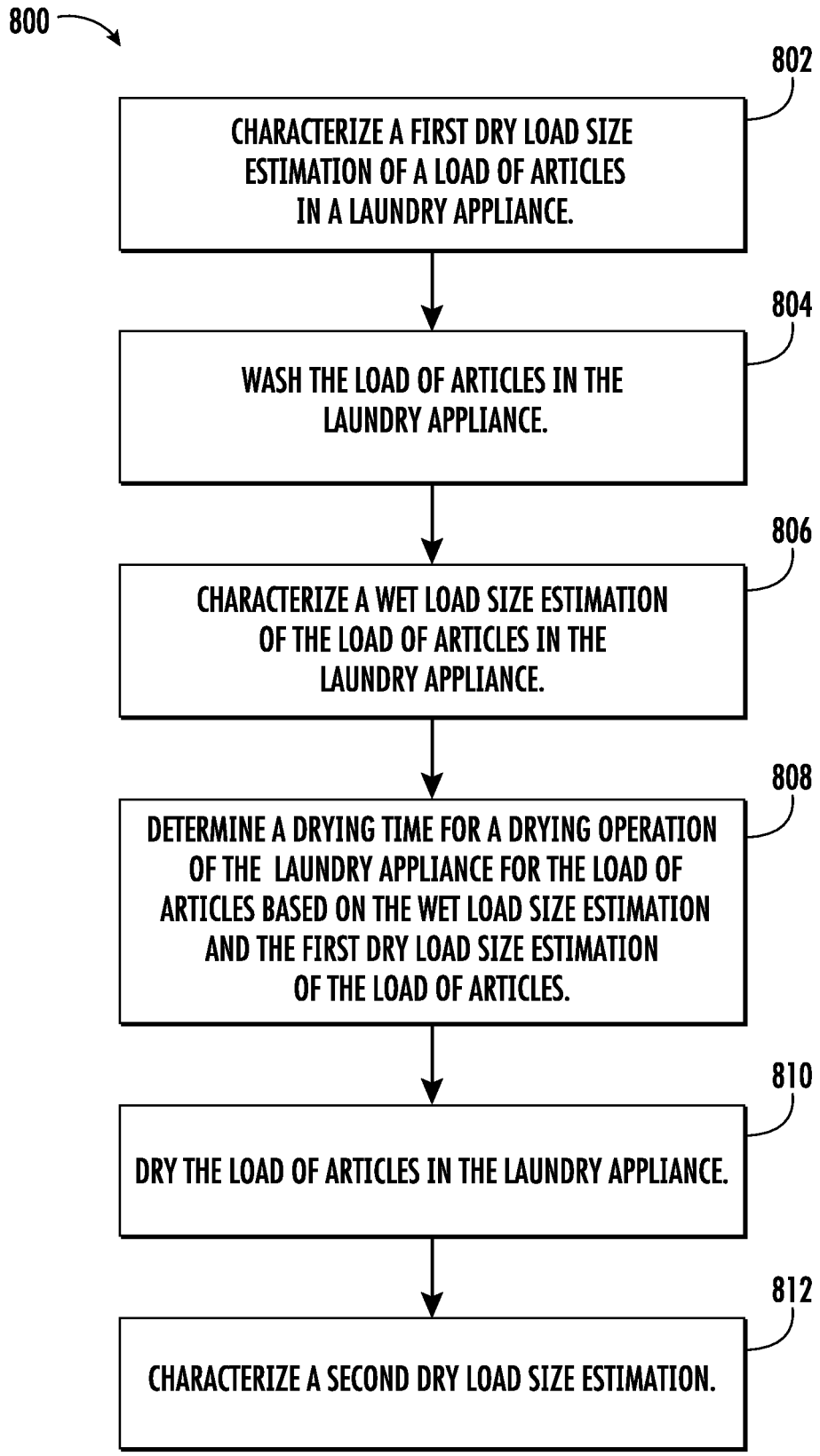
FIG. 8 illustrates a flow diagram of an example method of operating a laundry appliance according to aspects of the present disclosure.

Now that the configuration of controller 56 of laundry appliance 10, as well as controller 366 and controller 490 of washing machine appliance 300 and dryer appliance 410 respectively, have been described, FIG. 8 illustrates a method 800 for operating a washing machine appliance according to an example embodiment of the present subject matter. Method 800 can be used to operate any suitable laundry appliance, such as laundry appliance 10, as well as washing machine appliance 300 and dryer appliance 410, illustrated in FIGS. 1-7. For the sake of simplicity, method 800 will be described herein with particular reference to laundry appliance 10, by way of example only and without limiting the method 800 to any specific appliance configuration. For example, controller 56 may be programmed or configured to implement method 800. As another example, method 800 may be used to operate controller 366 and controller 490 of washing machine appliance 300 and dryer appliance 410 (FIGS. 4 and 6), respectively.

Referring now to FIG. 8, a flow diagram of one embodiment of a method 800 of controlling a laundry appliance is illustrated in accordance with aspects of the present subject matter. In general, the method 800 will be described herein with reference to the embodiments of the laundry appliance 10 described above with reference to FIGS. 1-3. However, it should be appreciated by those of ordinary skill in the art that the disclosed method 800 may generally be utilized in association with apparatuses and systems having any other suitable configuration, such as washing machine appliance 300 and dryer appliance 410 of FIGS. 4-7. In addition, although FIG. 8 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 8, at (802), method 800 may generally include characterizing, by a laundry appliance, e.g., the combination laundry appliance 10, washer appliance 300, or other similar laundry appliance, a first dry load size estimation of the load of articles in the laundry appliance. In general, the first dry load size estimation may be measured before the wash cycle while the clothes are dry. In particular, the first dry load size estimation may be an inertia of the load of articles, e.g., the first dry load size of the load of articles may be determined based on the measured inertia of the load of articles, while the load of articles is dry. Additionally, or alternatively, the first dry load size estimation may be determined from a spin cycle, e.g., characterizing the load of articles may be based on the spin cycle, and more specifically, a spin speed of a basket of the laundry appliance, e.g., basket 130 (FIG. 2) or basket 320 (FIG. 5) during the spin cycle, while the load of articles is dry.

At (804), method 800 may generally include washing the load of articles in the combination laundry appliance 10. In some example embodiments, an operation, such as washing the load of articles, may be initiated through operator manipulation of input selectors 70. For example, the wash cycle may be initiated such that tub 26 is filled with water, detergent, or other fluid additives, whereby the load of articles is washed, as is described above.

At (806), method 800 may generally include characterizing, by the laundry appliance, e.g., the combination laundry appliance 10, washer appliance 300, or other similar laundry appliance, a wet load size estimation of the load of articles in the laundry appliance. In general, the wet load size estimation may be measured after the wash cycle while the clothes are wet. In particular, the wet load size estimation may be an inertia of the load of articles, e.g., the wet load size of the load of articles may be determined based on the measured inertia of the load of articles, while the load of articles is wet. Additionally, or alternatively, the wet load size estimation may be determined from a spin cycle, e.g., characterizing the load of articles may be based on the spin cycle, and more specifically, a spin speed of the basket of the laundry appliance, e.g., basket 130 (FIG. 2) or basket 320 (FIG. 5) during the spin cycle, while the load of articles is wet.

At (808), method 800 may generally include determining a drying time for the drying operation of the laundry appliance, e.g., the combination laundry appliance 10, dryer appliance 410, or other similar laundry appliance, for the load of articles based on the wet load size estimation and the first dry load size estimation of the load of articles. For example, the drying time may generally be calculated through a function of the wet load size estimation compared with the first dry load size estimation. In other example embodiments, additional parameters may be considered when calculating the drying time to increase the accuracy of the drying time. For example, in some example embodiments, characterizing the load of articles may include characterizing a fabric type of the load of articles in the laundry appliance e.g., the combination laundry appliance 10, washer appliance 300, dryer appliance 410, or other similar laundry appliance. As stated above, the term "load type" corresponds to a composition or fabric type of articles, e.g., within the basket of the laundry appliance, e.g., basket 130

(FIG. 2) or basket 320 (FIG. 5), and the load type of such articles may be natural, synthetic, or blended, whereby, for example, natural articles such as cotton articles can have a relatively high absorptivity whereas synthetic articles, such as nylon or polyester articles, can have a relatively low absorptivity. As such, characterizing the fabric type of the load of articles may include determining the absorptivity of the load of articles and determining the load size of the load of articles based on the determined absorptivity of the load of articles. Another parameter which may impact the drying time is the initial moisture content (IMC). The IMC may depend upon the spinning performance of the basket of the laundry appliance, e.g., basket 130 (FIG. 2) or basket 320 (FIG. 5). In the case of high spin speed (e.g., about 1100 rpm) the IMC may be in the range of forty percent to thirty percent (40%-30%). In a scenario where the spinning speed is lower (e.g., about 600 rpm) the IMC should be between sixty percent to fifty percent (60%-50%), thus increasing the drying time because the dryer has to remove more water. In general, the IMC may be estimated using the following equation (1):

$$IMC = \frac{LS2 - LS1}{LS1} \cdot 100 \tag{1}$$

Here, LS1 is the first dry load size estimation, performed at the beginning of the washing cycle (e.g., at 802), and LS2 is the wet load size estimation, performed at the end of the washing cycle (e.g., at 806).

As stated above, the drying time may generally be calculated through a function of the wet load size estimation compared with the first dry load size estimation. In particular, the moisture content in the load of articles, e.g., the soaked laundry may be estimated using the following equation (2):

$$\text{soaked_laudry} = LS2 - LS1 \tag{2}$$

The soaked laundry value calculated in equation (2) may be used in a function to calculate the drying time, as detailed hereinbelow. Further, in some example embodiments, characterizing the load of articles may include receiving, by the laundry appliance, e.g., the combination laundry appliance 10, dryer appliance 410, or other similar laundry appliance, a user input including a cycle selection for drying the load of articles. In particular, the cycle selection for drying the load of articles may include one of eco-dry, dry, and more dry, whereby the eco-dry, dry, and more dry, respectively, indicate increasing temperature for drying the load of articles. In particular, a final moisture content (FMC) may be a percentage of moisture remaining in the load of articles at the completion of the drying cycle. Each cycle selection may indicate a different FMC value for the cycle to be considered complete, e.g., eco-dry may indicate an FMC of six percent (6%), dry may indicate an FMC of five percent (5%), and more dry may indicate an FMC of three percent (3%). One of skill in the art would generally understand the cycle selection as including options for heat intensity, such as low, medium, and high, and that eco-dry, dry, and more dry are provided for example purposes only. As such, in some example embodiment, determining the drying time for the drying operation of the laundry appliance for the load of articles may be based on a function of the wet load size estimation, the first dry load size estimation of the load of articles, the fabric type, and the cycle selection. In particular, the drying time may be estimated using the following equation (3):

$$\text{drying_time} = f\,(\text{fabric_type, dryness_level, soaked_laudry}) \tag{3}$$

Here, fabric type may be determined as described above with respect to step (808), dryness level may refer to the FMC as described above, and the soaked laundry may be the moisture content calculated via equation (2). Each of these variables may be considered in equation (3) in order to calculate the drying time.

At (810), method 800 may generally include drying the load of articles in the laundry appliance, e.g., the combination laundry appliance 10, dryer appliance 410, or other similar laundry appliance, for the determined drying time. In some example embodiments, an operation, such as drying the load of articles, may be initiated through operator manipulation of input selectors, such as input selectors 70 (FIG. 1) or input selectors 470 (FIG. 7). In particular, as illustrated and described in FIG. 3, the load of articles may be dried during drying operations of the laundry appliance 10.

At (812), method 800 may generally include characterizing, by the laundry appliance, e.g., the combination laundry appliance 10, dryer appliance 410, or other similar laundry appliance, a second dry load size estimation (LS3). In general, the second dry load size estimation may be measured after the dry cycle when the clothes may be dry. In particular, the second dry load size estimation may be an inertia of the load of articles, e.g., the second dry load size of the load of articles may be determined based on the measured inertia of the load of articles, when the load of articles may be dry. Additionally, or alternatively, the second dry load size estimation may be determined from a spin cycle, e.g., characterizing the load of articles may be based on the spin cycle, and more specifically, a spin speed of the basket of the laundry appliance, e.g., basket 130 (FIG. 2) or drum 426 (FIG. 7). during the spin cycle, when the load of articles may be dry.

In some example embodiments, method 800 may further include updating the drying time in response to the first dry load size estimation and the second dry load size estimation of the load of articles. In particular, in a scenario where the second dry load size estimation is greater than the first dry load size estimation, the load of articles may not be dried properly. Accordingly, more time may be automatically added to the drying time in order to dry the load of articles. In particular, when the drying time elapses and the second dry load size estimation is equal to or less than the first dry load size estimation, then the laundry is dry. However, when the second dry load size estimation is greater than the first dry load size estimation, then the laundry is not dry, and thus, a new drying time may be calculated. For example, a new soaked laundry and a new drying time may be estimated using the following equations (4) and (5):

$$\text{soaked_laudry_2} = (LS3 - LS1) \cdot \text{drying_gain} \tag{4}$$

$$\text{new_drying_time} = f\,(\text{fabric_type, dryness_level, new_soaked_laudry}) \cdot \text{drying_gain} \tag{5}$$

Here, drying gain is considered a safety factor in order to stop the cycle with dry laundry. In general, the drying gain may aid preventing or reducing over-drying the load of articles.

As may be seen from the above, a method of controlling a combination laundry appliance, or connected washer-dryer appliances, that estimates water soaked by laundry based on load size estimation at the beginning of washing and drying phases and estimates a drying cycle time may be advantageous to avoiding over-drying of the load of articles. Further, the drying cycle time estimation may be improved either by considering a fabric type and water-soaked estimation or by considering a desired dryness level, e.g., cycle selection, set by the user, and the water-soaked estimation. Accordingly, the drying cycle time estimation may be further improved by considering the additional parameters such as the fabric type, the desired dryness level, and water soaked estimation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a combination laundry appliance, the combination laundry appliance comprising both a washing machine appliance and a dryer appliance, the method comprising:

characterizing, by the combination laundry appliance, a first dry load size estimation of a load of articles in the combination laundry appliance;

washing the load of articles in the combination laundry appliance;

characterizing, by the combination laundry appliance, a wet load size estimation of the load of articles in the combination laundry appliance;

determining a drying time for a drying operation of the combination laundry appliance for the load of articles based on the wet load size estimation and the first dry load size estimation of the load of articles;

drying the load of articles in the combination laundry appliance for the determined drying time; and characterizing, by the combination laundry appliance, a second dry load size estimation of the load of articles.

2. The method of claim 1, further comprising updating the drying time in response to the first dry load size estimation and the second dry load size estimation of the load of articles.

3. The method of claim 1, wherein characterizing the load of articles comprises measuring an inertia of the load of articles and determining a load size of the load of articles based on the measured inertia of the load of articles.

4. The method of claim 1, wherein washing the load of articles in the combination laundry appliance comprises performing a spin cycle, and wherein characterizing the load of articles is based on the spin cycle.

5. The method of claim 1, wherein characterizing the load of articles comprises characterizing a fabric type of the load of articles in the combination laundry appliance.

6. The method of claim 5, wherein characterizing the fabric type of the load of articles comprises determining an absorptivity of the load of articles and determining a load size of the load of articles based on the determined absorptivity of the load of articles.

7. The method of claim 6, wherein characterizing the load of articles comprises receiving, by the combination laundry appliance, a user input comprising a cycle selection for drying the load of articles.

8. The method of claim 7, wherein the cycle selection for drying the load of articles comprises one of eco-dry, dry, and more dry, whereby the eco-dry, dry, and more dry, respectively, indicate increasing temperature for drying the load of articles.

9. The method of claim 8, wherein determining a drying time for a drying operation of the combination laundry appliance for the load of articles is based on the wet load size estimation, the first dry load size estimation of the load of articles, the fabric type, and the cycle selection.

10. A method of operating both of a washing machine appliance and a dryer appliance, the method comprising:

characterizing, by the washing machine appliance, a first dry load size estimation of a load of articles in the washing machine appliance;

washing the load of articles in the washing machine appliance;

characterizing, by the washing machine appliance, a wet load size estimation of the load of articles in the washing machine appliance;

determining a drying time for a drying operation of the dryer appliance for the load of articles based on the wet load size estimation and the first dry load size estimation of the load of articles;

drying the load of articles in the dryer appliance;

characterizing, by the dryer appliance, a second dry load size estimation of the load of articles; and updating the drying time in response to the first dry load size estimation and the second dry load size estimation of the load of articles.

11. The method of claim 10, wherein characterizing the load of articles comprises measuring an inertia of the load of articles and determining a load size of the load of articles based on the measured inertia of the load of articles.

12. The method of claim 10, wherein washing the load of articles in the washing machine appliance comprises performing a spin cycle, and wherein characterizing the load of articles is based on the spin cycle.

13. The method of claim 10, wherein characterizing the load of articles comprises characterizing a fabric type of the load of articles in the washing machine appliance.

14. The method of claim 13, wherein characterizing the fabric type of the load of articles comprises determining an absorptivity of the load of articles and determining a load size of the load of articles based on the determined absorptivity of the load of articles.

15. The method of claim 14, wherein characterizing the load of articles comprises receiving, by the washing machine appliance, a user input comprising a cycle selection for drying the load of articles.

16. The method of claim 15, wherein the cycle selection for drying the load of articles comprises one of eco-dry, dry, and more dry, whereby the eco-dry, dry, and more dry, respectively, indicate increasing temperature for drying the load of articles.

17. The method of claim 16, wherein determining a drying time for a drying operation of the dryer appliance for the load of articles is based on the wet load size estimation, the first dry load size estimation of the load of articles, the fabric type, and the cycle selection.

18. A method of operating both of a washing machine appliance and a dryer appliance, the method comprising:

characterizing, by the washing machine appliance, a first dry load size estimation of a load of articles in the washing machine appliance;

washing the load of articles in the washing machine appliance;

characterizing, by the washing machine appliance, a wet load size estimation of the load of articles in the washing machine appliance;

determining a drying time for a drying operation of the dryer appliance for the load of articles based on the wet load size estimation and the first dry load size estimation of the load of articles; and drying the load of articles in the dryer appliance, wherein characterizing the load of articles comprises characterizing a fabric type of the load of articles in the washing machine appliance.

19. The method of claim 18, wherein characterizing the fabric type of the load of articles comprises determining an absorptivity of the load of articles and determining a load size of the load of articles based on the determined absorptivity of the load of articles.

20. The method of claim 19, wherein characterizing the load of articles comprises receiving, by the washing machine appliance, a user input comprising a cycle selection for drying the load of articles.

* * * * *